US007322138B2

(12) United States Patent
Gormley et al.

(10) Patent No.: US 7,322,138 B2
(45) Date of Patent: Jan. 29, 2008

(54) SHELF EDGE SIGN HOLDER

(75) Inventors: Joseph E. Gormley, Rockford, IL (US); Patrick J. Barkdoll, Pecatonica, IL (US)

(73) Assignee: Southern Imperial, Inc., Rockford, IL (US)

( * ) Notice: Subject to any disclaimer, the term of this patent is extended or adjusted under 35 U.S.C. 154(b) by 185 days.

(21) Appl. No.: 11/216,447

(22) Filed: Aug. 31, 2005

(65) Prior Publication Data

US 2007/0044361 A1 Mar. 1, 2007

(51) Int. Cl.
*G09F 3/20* (2006.01)

(52) U.S. Cl. ..... 40/658; 40/648; 40/649; 40/642.02; 40/661.11; 40/655; 211/57.1; 24/453; 403/329

(58) Field of Classification Search ..... 40/658, 40/648, 649, 642.02, 661.11, 666, 655, 667, 40/651, 652, 607.14, 611.12; 24/453; 403/329; 211/57.1
See application file for complete search history.

(56) References Cited

U.S. PATENT DOCUMENTS 3,057,093 A * 10/1962 Gallo ..... 40/645
3,324,585 A 6/1967 Frederickson
4,572,380 A * 2/1986 Langwell ..... 211/57.1
5,047,117 A 9/1991 Roberts
5,053,105 A 10/1991 Fox, III
5,117,027 A 5/1992 Bernhardt et al.
5,339,967 A * 8/1994 Valiulis ..... 211/57.1
5,375,803 A 12/1994 Kump
5,998,256 A 12/1999 Juengling
6,082,687 A * 7/2000 Kump et al. ..... 248/220.41
6,383,907 B1 5/2002 Hasegawa et al.
6,395,613 B1 5/2002 Juengling
6,514,884 B2 2/2003 Maeda
6,686,245 B1 2/2004 Mathew et al.
6,794,699 B2 9/2004 Bissey et al.
6,800,930 B2 10/2004 Jackson et al.
6,962,867 B2 11/2005 Jackson et al.
7,114,277 B2 * 10/2006 Valiulis et al. ..... 40/648
2002/0045308 A1 4/2002 Juengling
2002/0127810 A1 9/2002 Nakamura et al.
2003/0127426 A1 7/2003 Chang et al.
2003/0207584 A1 11/2003 Sivakumar et al.
2004/0018738 A1 1/2004 Liu
2004/0041189 A1 3/2004 Voshell et al.

(Continued)

FOREIGN PATENT DOCUMENTS

WO WO 2004/001799 A2 12/2003

(Continued)

OTHER PUBLICATIONS

U.S. Appl. No. 10/864,654, Valiulis et al.

(Continued)

*Primary Examiner*—Lesley D. Morris
*Assistant Examiner*—Shin Kim
(74) *Attorney, Agent, or Firm*—Reinhart Boerner Van Deuren P.C.

(57) ABSTRACT

A sign holder for a retail display comprises a resilient plastic molded body. The body includes two or more resilient clasps projecting from a common base to resiliently hold a retail display sign therebetween.

18 Claims, 14 Drawing Sheets

U.S. PATENT DOCUMENTS

| | | | |
|---|---|---|---|
| 2004/0079988 | A1 | 4/2004 | Harari |
| 2004/0235255 | A1 | 11/2004 | Tanaka |
| 2005/0164454 | A1 | 7/2005 | Leslie |
| 2005/0186705 | A1 | 8/2005 | Jackson et al. |
| 2006/0046484 | A1 | 3/2006 | Abatchev et al. |

FOREIGN PATENT DOCUMENTS

| | | |
|---|---|---|
| WO | WO 2004/003977 | 1/2004 |

OTHER PUBLICATIONS

B. Lim, Nature vol. 2, Nov. (2003) pp. 749-753.

* cited by examiner

FIG. 3
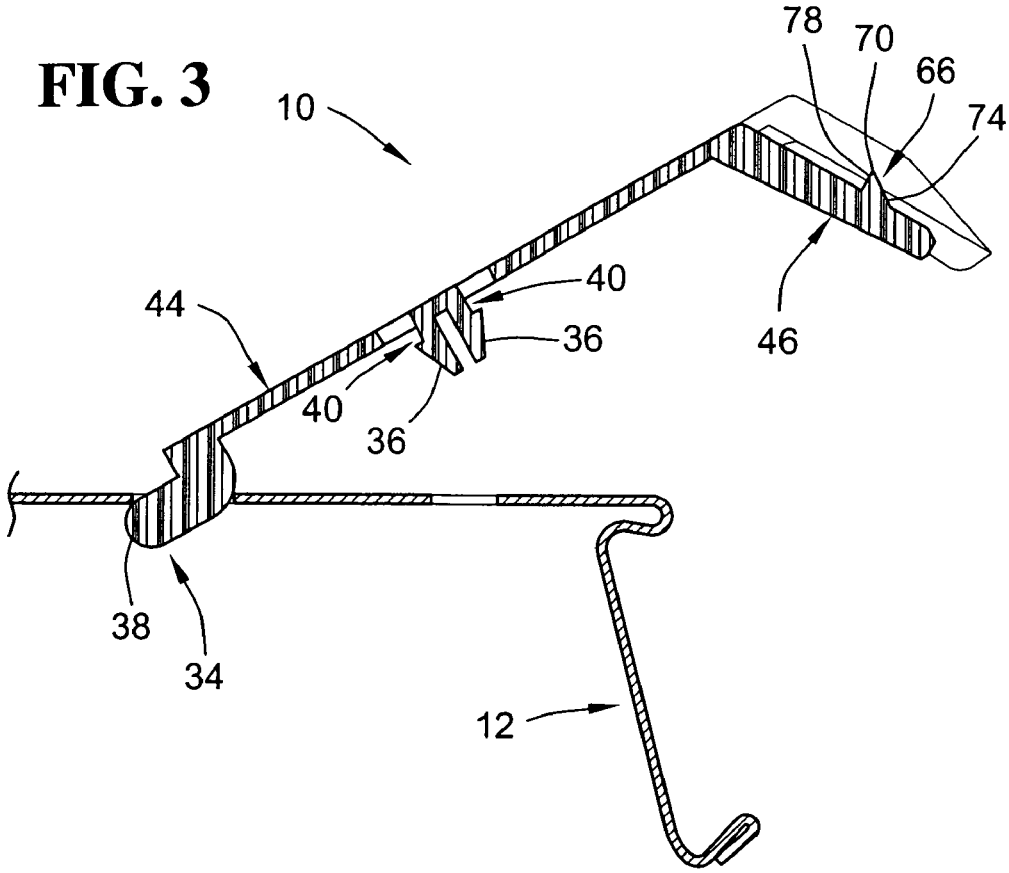
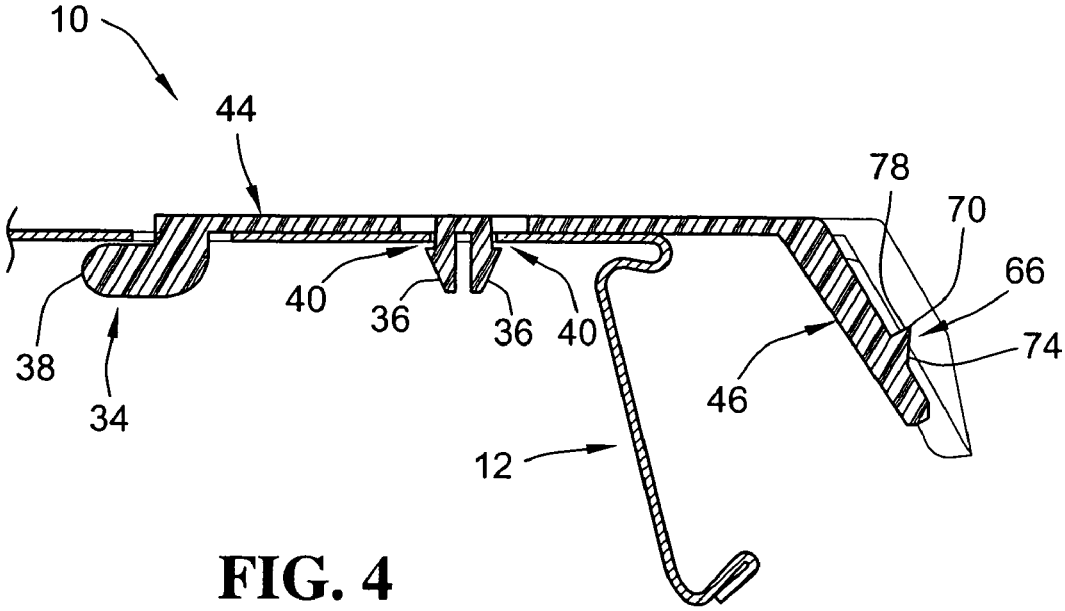
FIG. 4

SHELF EDGE SIGN HOLDER

FIELD OF THE INVENTION

The present invention generally pertains to sign holders and, more particularly, to sign holders that are adapted to be mounted onto a shelf for displaying a planar sign, the sign conveying product information in a retail store environment.

BACKGROUND OF THE INVENTION

Often, to promote certain products retailers will display planar paper material signs on shelves where products are located at a retail store establishment. For example, retail establishments typically have numerous signs to identify information about associated products such as price or nutrition, or to identify a certain promotion or sale offering. To securely hold and display the signs in a conspicuous location, sign holders are often used. Examples of such sign holders are exemplified by U.S. Pat. No. 5,375,803 to Kump and pending application Ser. No. 10/864,654 entitled "Sign Holder," the entire disclosures of which are hereby incorporated by this reference.

As indicated in these aforementioned patent references, the sign holder can be mounted to the shelf and can include a retaining structure that securely holds the sign. Typically, the sign will be punctured by the sign holder, in order to ensure that the sign is secured and does not fall off the sign holder. However, puncturing the sign provides certain drawbacks. For example, if the sign is not punctured in the correct location, it needs to be re-punctured such that the sign can be destroyed or aesthetically unattractive, Also, once punctured, the sign may not be readily removable or suitable for reuse, such that the sign may not be readily repositioned. Finally, close tolerances arise when attempting to provide a structure that both punctures a sign and also snaps together, which impose difficulties. Accordingly, there is room for additional improvements in the state in the art.

BRIEF SUMMARY OF THE INVENTION

It is a general object, according to one aspect of the present invention, to provide a sign holder capable of securely holding a sign without puncturing a sign.

It is another object of the present invention according to a different aspect to avoid snapping mechanisms that hold mating portions of the sign together.

In accordance with these general objectives, the present invention is directed towards a sign holder that resiliently grips the sign.

According to one aspect of the present invention, a retail display comprises a sign holder in combination with a sign having a retail information indicia pertaining to merchandise and a retail shelf having a support panel for support of merchandise, with a front face along the retail shelf. The sign holder is mounted to the shelf and comprises a body molded of resilient plastic material with a common base that is proximate the front face of the shelf. A plurality of clasps are integrally joined to the base and each project outwardly from the base. The clasps are resiliently flexible but otherwise non-movable relative to the base (e.g., the clasps do not pivot via a living hinge as per the afore-referenced patent application and patent). The clasps include at least a first clasp and a second clasp which are in substantially fixed space relation to one another, in which the first and second clasp hold opposing sides of the sign. Additionally, at least one gripping tab projects from at least one of the clasps in which the gripping tab engages the sign to prevent the sign becoming unintentionally dislodged from the sign holder.

Another aspect of the present invention is a sign holder that is adapted to be mounted to a retail display in which the sign holder comprises a body molded of resilient plastic material which is formed with a common base. The body includes means for mounting the body to the retail shelf and positioning the common base along the front face of the shelf. A plurality of clasps are integrally joined to the base in which each of the clasps project outward from the base and are resiliently flexible. Clasps include at least first and second clasps in substantially fixed relation (e.g. thus permitting resilient flexure), which define a slot extending from the common base towards an entrance opening defined between opposed internal slot walls of the first and second clasp. At least one gripping tab projects from at least one of the clasps in which the gripping tab projects into the slot defined between the two clasps.

In accordance with certain embodiments of the present invention, a further aspect along the same lines in the above paragraph is the provision of a third clasp integral with the common base that extends outward from the common base in spaced relation to the first clasp to form a gap between these two clasps. The second clasp is disposed intermediate the first and third clasp such that the sign is adapted to be disposed in a slot formed between the second clasp on one side and a first and third clasp on a second side of the sign. A further advantageous aspect according to this configuration is the provision of the at least one gripping tab to be formed on the second clasp to project inwardly towards the gap formed between the first and third clasp. The tab may be pointed to provide a localized area of impact.

Other aspects, objectives and advantages of the invention will become more apparent from the following detailed description when taken in conjunction with the accompanying drawings.

BRIEF DESCRIPTION OF THE DRAWINGS

FIG. 3 and FIG. 4 are cross sections of the sign holder of the first embodiment in association with an exemplary retail shelf showing how the sign holder is pivotally mounted and snapped into the rows of holes formed in the planar top surface of the shelf;

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
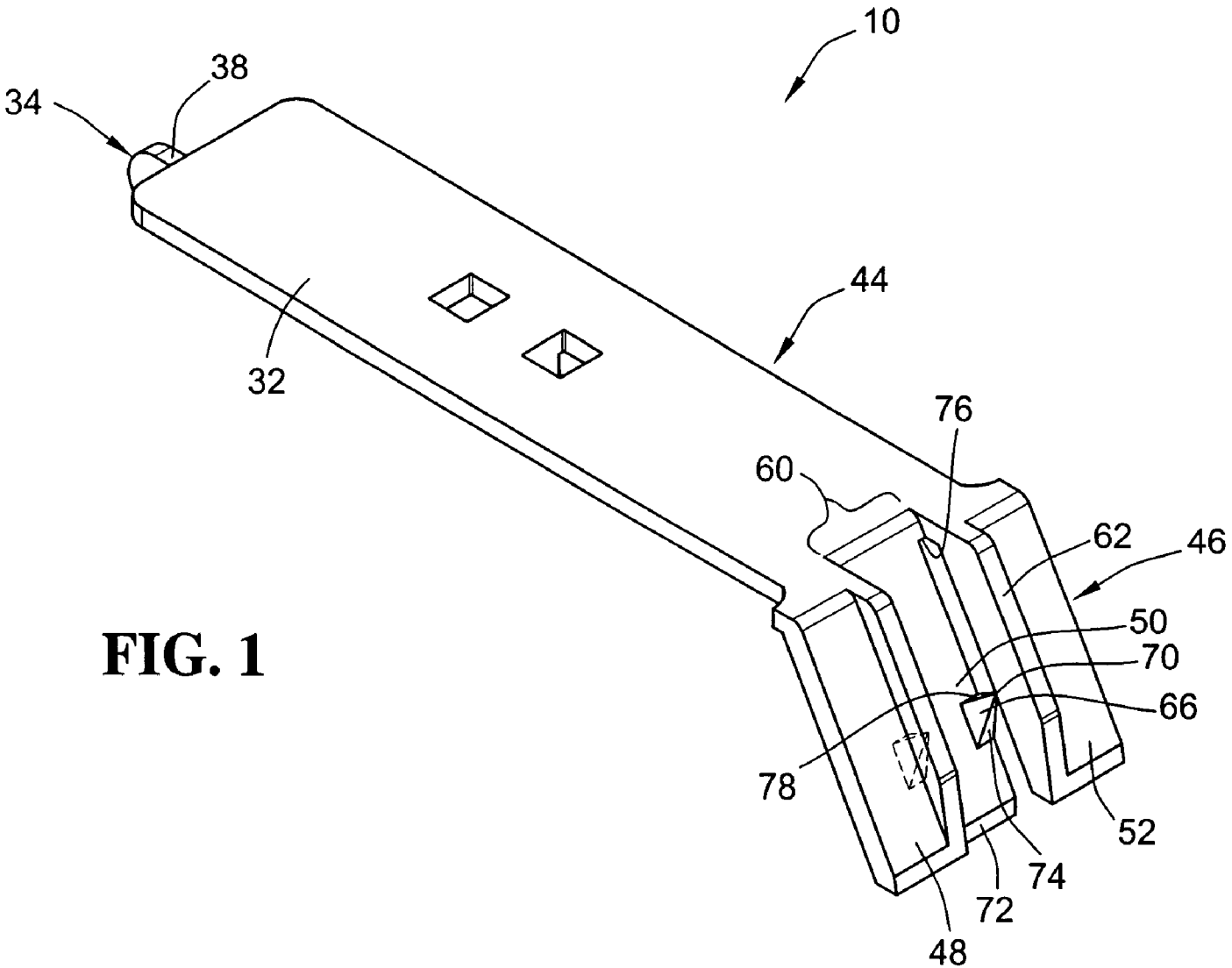
FIG. 1 is an isometric view of a sign holder according to a first embodiment of the present invention.
Figure 2:
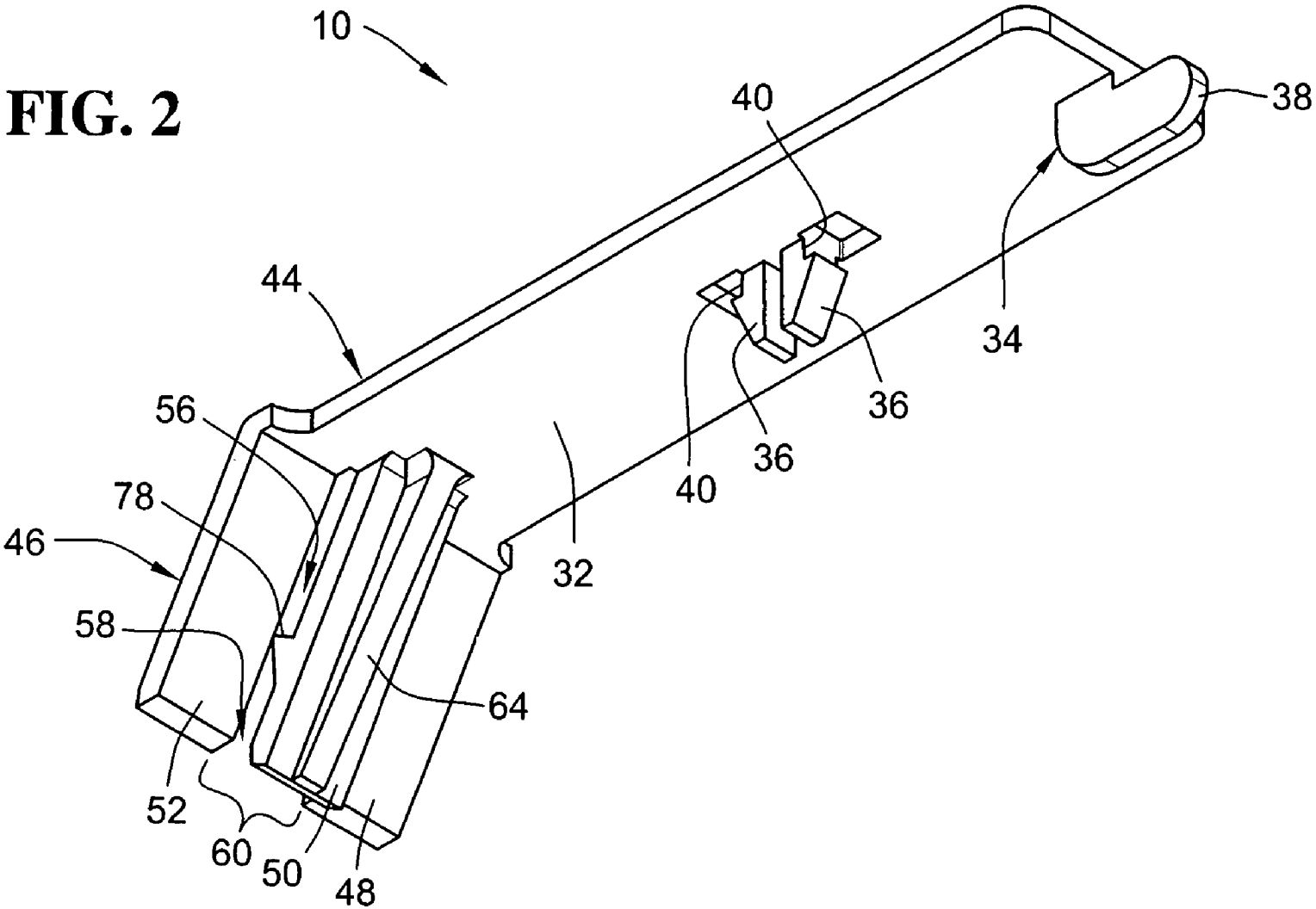
FIG. 2 is another isometric view taken from a different perspective of the sign holder shown in FIG. 1.
Figure 5:
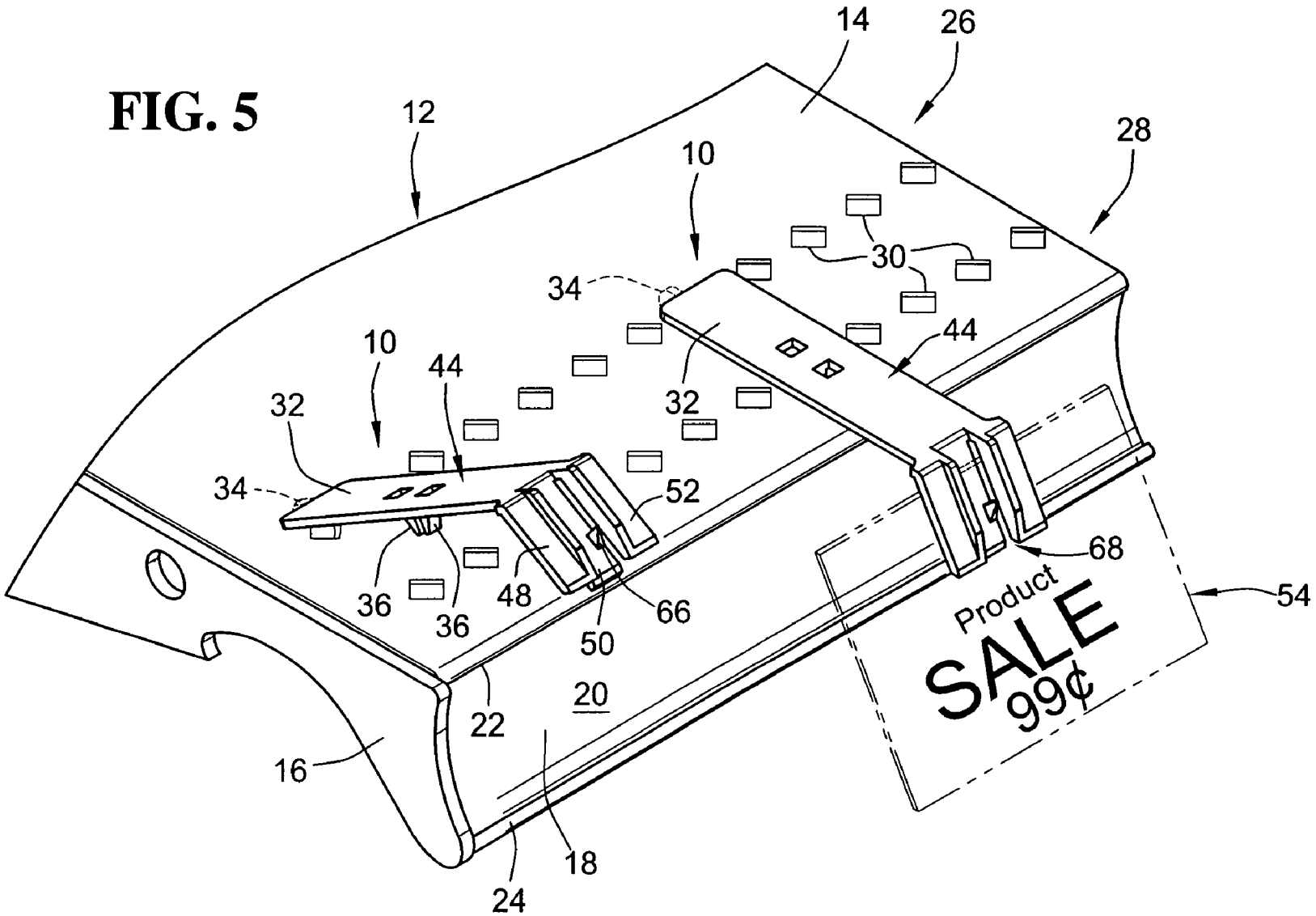
FIG. 5 is an isometric view of two sign holders, one in an about-mounted position and another in a mounted position to a shelf with the mounted sign holder holding and front facing a retail display sign.

Turning to FIG. 1, a first embodiment of the present invention is illustrated as a sign holder 10 that can be mounted on a retail shelf 12 as shown, for example, in FIG. 5. FIG. 5 illustrates the environment under which the sign holder 10 of the present invention may operate. As shown therein, a retail shelf 12 typically includes a generally horizontal (which includes truly horizontal and/or slanted slightly and/or gravitational self-facing displays) top panel 14 and vertically extending arms 16 (which connect and mount two vertical supports at the back end, with only one arm 16 being shown in FIG. 5). Across the front of the retail shelf 12 is a display front which may take the form as a C-channel 18 as shown with a curved concaved backface 20 and upper and lower lips 22, 24 which extend laterally in vertical spaced relation. Additionally, and as is conventional, the top panel 14 has formed holes arranged into two rows 26, 28 of mounting apertures 30 which extend laterally across the length of the retail shelf 12 in horizontal and parallel spaced relation. Mounting apertures 30 are provided proximate the front end of the retail shelf, which is proximate the location of the C-channel 18.

Figure 14:
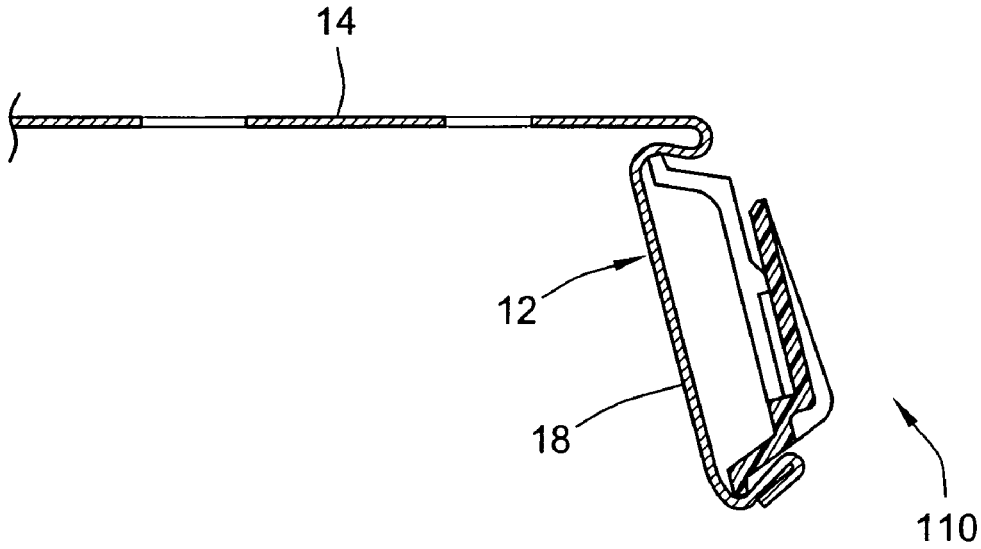
FIGS. 14 and 15 are cross sectional views of a third and fourth embodiments snapped into a C-channel of a retail shelf, respectively.
Figure 15:
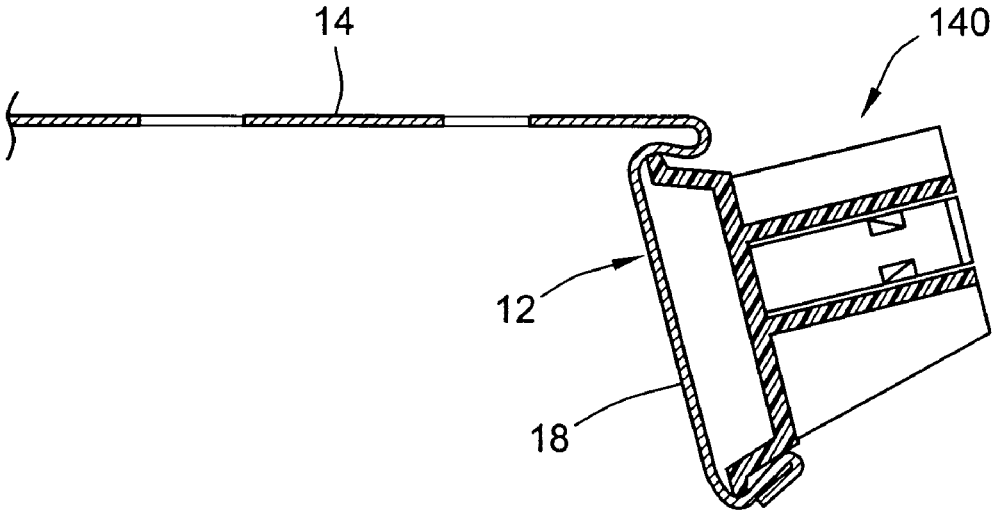
Figure 16:
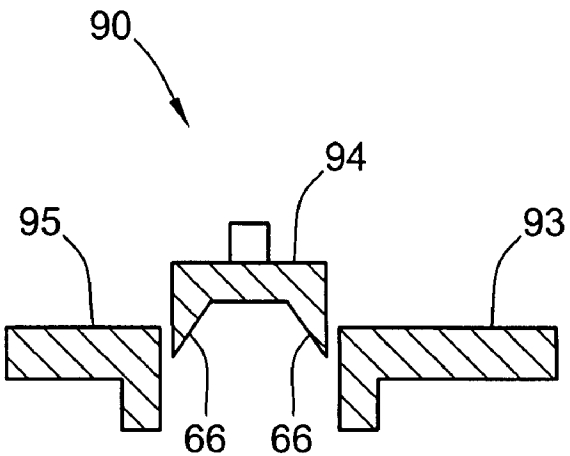
FIG. 16 is a cross sectional view taken through the clasp of the second embodiment without a sign installed therein and FIG. 17 shows cross section taken perpendicular relative to that of FIG. 16 showing a sign that is about to be installed into a slot formed between the clasps.
Figure 17:
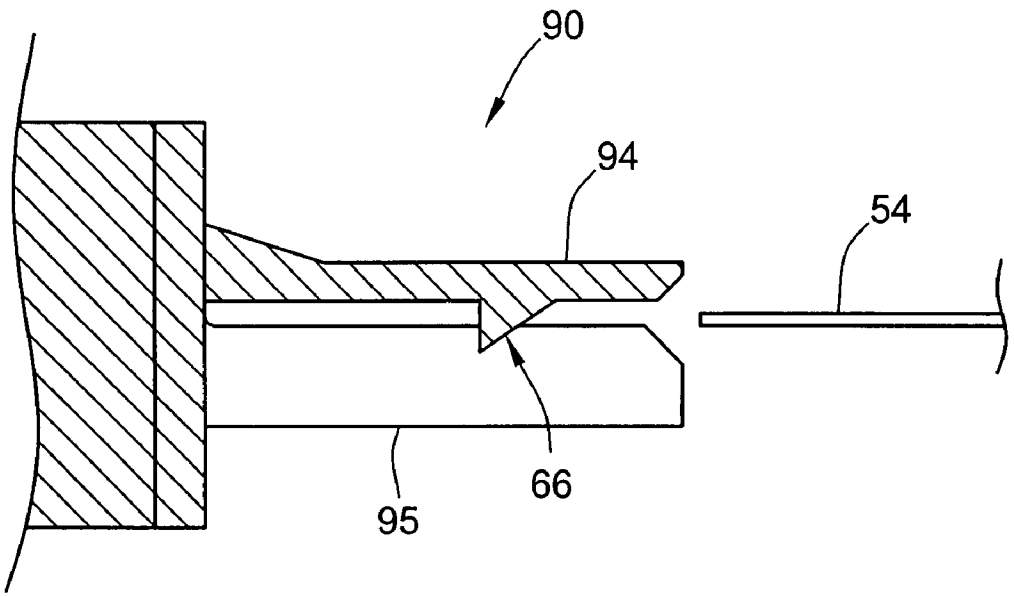
Figure 18:
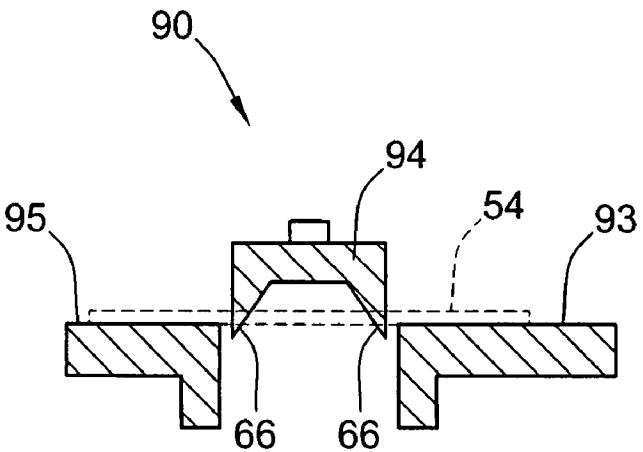
FIGS. 18 and 19 are similar to the illustrations of FIGS. 16 and 17, respectively, but for the fact that the sign has been advanced to engage the cam surface on the gripping tab to resiliently flex the clasps apart to facilitate insertion of the sign.
Figure 19:
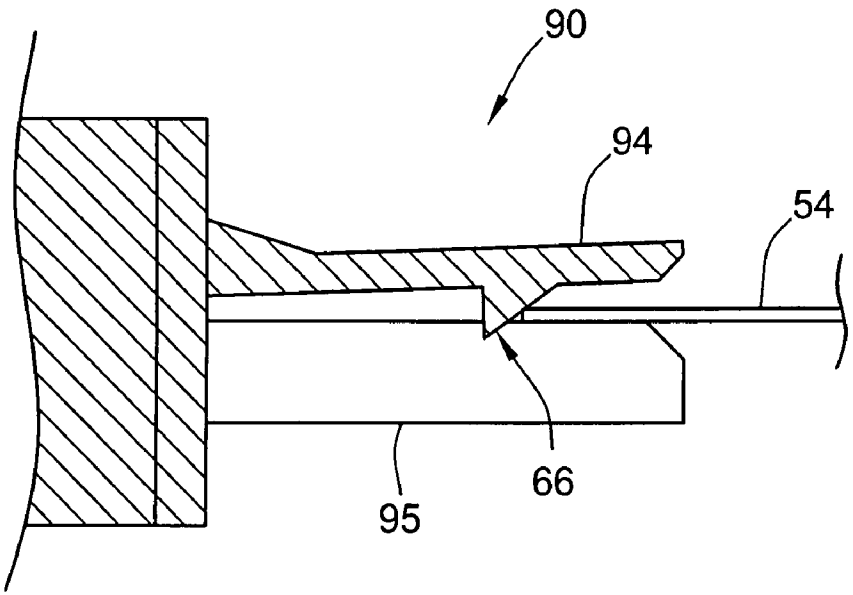
Figure 20:
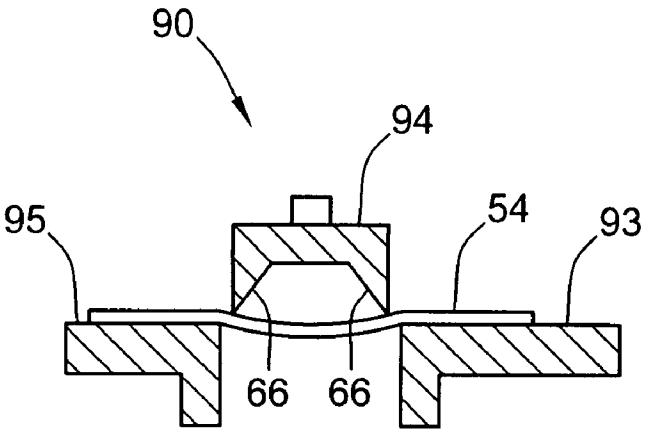
FIGS. 20 and 21 are similar to the illustrations of FIGS. 18 and 19, respectively, but further show the sign advanced and installed all the way into the slot with the sign being partially deformed to be received into a gap formed between two of the clasps by the intermediate clasp.
Figure 21:
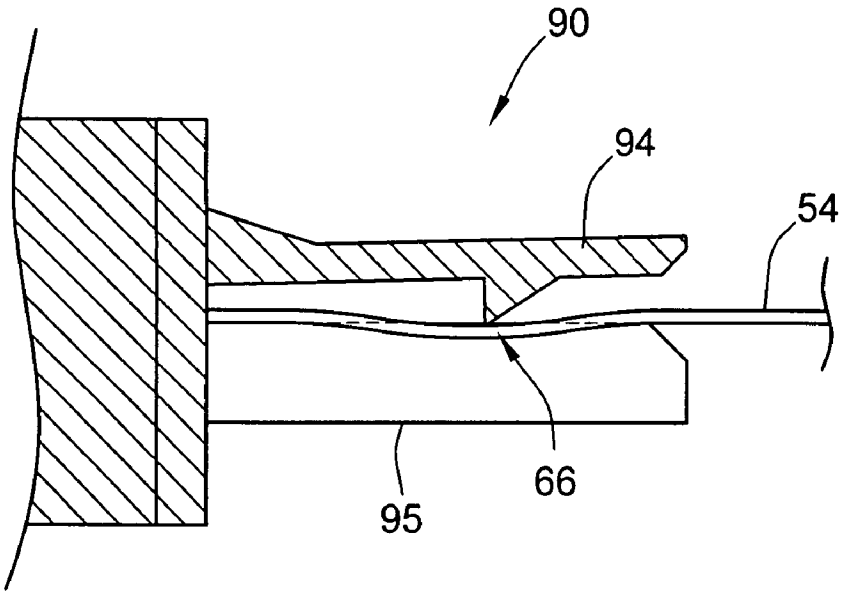

As is also shown in FIG. 5 and with additional reference to FIGS. 3 and 4, the sign holder 10 is mounted to the retail shelf 12 using suitable mounting means for mounting the sign holder 10 to the retail shelf 12. As shown in FIGS. 3-5, the rows 26, 28 of mounting apertures 30 may be utilized for this function, however, it will readily be appreciated that the C-channel may alternatively or additionally be used with mounting means of the sign holder as shown for later embodiments (see e.g., FIGS. 14 and 15). With respect to the first embodiment, the sign holder 10 includes a mounting panel 32 which integrally carries clasps at its front end, to be discussed in further detail herein.

The mounting panel 32 is adapted to be positioned in flush relation against the top panel 14 of the retail shelf 12. The mounting panel 32 provides mounting means in a first embodiment which comprises one or more of the following features, to include an L-shaped anchor arm projecting from the underside of the mounting panel 32, and or at least one and preferably two snap prongs 36, also projecting from the underside of the mounting panel 32. The means may also include any other projection configured to be received into mounting holes. In this embodiment, the anchor arm 34 is positioned and aligned to be pivotably received within one of the apertures 30 of the second row 28 (which is the back row). The anchor arm 34 includes a vertically extending portion as well as a horizontally extending portion. The one or more snap prongs 36 are formed of resilient material and include a cam surface 38 which may comprise a taper to facilitate inward deflection of the snap prongs to be received within one of the apertures 30 of the first row 26 (which is the front row). Once the snap prongs 36 are received within one of the mounting apertures 30 of the first row 26 and are deflected inward by virtue of the cam surface 38, the snap prongs 36 deflect outward with notches 40 being received along the thickness of the shelf top panel 14. Corresponding abutment surfaces formed into the snap prongs 36 along an edge of the notches 40 prevent the inadvertent removal of the sign holder 10 from the retail shelf 12 once mounted thereto.

As indicated above, the sign holder preferably includes resiliently deformable material. One way of manufacturing or forming the sign holder 10 of the present invention is to mold the sign holder with a body 44 of resilient plastic material. The sign holder 10 may be formed of separate parts integrally connected together or otherwise integrally formed as a single unitary molded component without separate parts, which is a more preferable implementation of the invention. As indicated, the body 44 includes the mounting panel 32 which provides certain mounting means, but also includes a common base 46 from which sign holding clasps protrude (to include at least two clasps and preferably three or more clasps).

In a first embodiment, the sign holder 10 includes three clasps 48, 50, 52 which facilitate holding of a retail sign 54 at a front-facing orientation (rather than sideways) with a slight angle relative to vertical. Each of the clasps 48, 50, 52 are integrally joined to the base and project outward from the base and are resiliently flexible but otherwise non-moveable relative to the base 46. Two of the outer clasps 48, 52 engage one side of the retail sign 54 while the intermediate clasp 50 engages the other side of the sign. Thus, the intermediate clasp 50 is disposed intermediate the outer clasps 48, 52.

In addition to being spaced horizontally, the clasps are also space laterally so as to define a slot 56 between the intermediate clasp 50 on the one hand the outer clasp 48, 52 on the other hand. The slot 56 extends from the common base 46 to an open entrance 58 defined at the free end of the clasp.

As mentioned above, the clasps 48, 50, 52 being formed of plastic material and integrally joined to the base 46 are non-moveable relative to the base 46 except that each of the clasps are resiliently flexible such that they can move a limited range relative to each other. As can be seen, the outer clasps 48, 52 define a central gap 60 therebetween which receives the intermediate clasp 50. The intermediate clasp 50 has a slightly smaller width than the width of the corresponding gap 60 such that it may be resiliently deflected therein however the clearance is relatively close so as to provide for relatively secure holding of the retail sign 54 when in use.

As shown in the figures, each of the outer clasps my include a reinforcement rib 62 which extends from the common base 46 to a location at or approximate the open entrance 58 to provide a means for strengthening and resisting flexible deflection of the clasps 48, 52. Preferably, the reinforcement ribs 62 are located directly adjacent the outer edges of the intermediate clasp 50 (thus defining the gap 60 therebetween). Additionally, the intermediate clasp may also include a reinforcement rib 64 which can be centralized along the length of the intermediate clasp 50, extending from the common base 46 outward to or proximate a location near the entrance 58.

Additionally, the intermediate clasp 50 includes at least one and preferably two or more gripping tabs 66 projecting into the defined slot 56 which is formed between the clasps. The gripping tabs 66 serve the function of impacting and gripping one side of the retail sign 54, and preferably deflecting part of the retail sign 54 into an area defined between the outer clasps 48, 52 thereby trapping an intermediate portion 68 of the retail sign 64. As shown in the first embodiment, preferably each of the gripping tabs 66 is located on either side of the intermediate clasp 50 proximate the innermost edge of the outer clasps 48, 52. Each of the gripping tabs 66 preferably includes a pointed end 70 so as to maximize the relative locational force applied to the retail sign 54 and thereby provide for maximum securement. However, it should be noted that the pointed ends 70 are not intended to puncture and penetrate all the way through the retail sign 54, but rather merely provide a means for more securely securing the retail sign 54 to the sign holder 10 through localized impact and/or sign deflection. In this manner, the retail sign 54 can readily be removed and repositioned within the sign holder 10 without having to puncture or destroy the retail sign (e.g., there are typically no punctured holes extending through the retail sign).

In operation, the retail sign 54 will be installed through the open entrance 58 defined between the clasps 48, 50, 52. Corresponding chamfer 72 disposed along the entrance 58 will more easily facilitate insertion of an appropriate retail sign 54 and start at least initially a relative outward deflection of the intermediate clasps 50 in one direction and the outer clasps 48, 52 in an opposite direction. In this manner, the resilient nature of the material of the clasps and integral joining connection to the common base causes the clasps to provide an inward force to start to grip the sign already. As the sign 54 is inserted further it will engage the cam surface in the form of a chamfered forward side 74 of the gripping tabs 66 which cause the intermediate clasp 50 to deflect even more away from the outer clasp 48, 52. This causes a more inward gripping force caused by each of the clasps through the generally resilient nature of the clasp. Additionally, the intermediate clasp 50 and the gripping tabs will tend to deflect and cause and intermediate portion 68 of the retail sign (assuming it is sufficiently deformable) to be received and trapped laterally between the inner and outer clasp 48, 52. The retail sign 54 may be installed until the forward edge of the retail sign engages and abuts against the bottom 76 of the slot which in this embodiment may be defined by the base of the outer clasps 48, 52. While the forward or front end of the gripping tab 66 may be chamfered as shown at reference characters 74, preferably the backside 78 relative to the entrance is more square or substantially perpendicular or otherwise not chamfered so as to prevent the retail sign 54 from easily being removed from the sign holder 10. The backside 78 thus prevents ready removal of the sign 54.

It should be appreciated that the sign material 54 can be of any suitable material for a retail sign, which may typically include either paper, hard paper, cardboard material, and/or plastic. The material is relatively thin and typically somewhere between a millimeter and about five millimeters in material thickness and the sign can be of any conventional size. Typically, the sign will include pertinent retail information to include information about the product stored on the shelf such as product name, pricing, barcode information and relevant product stocking or other numbers.

Figure 6:
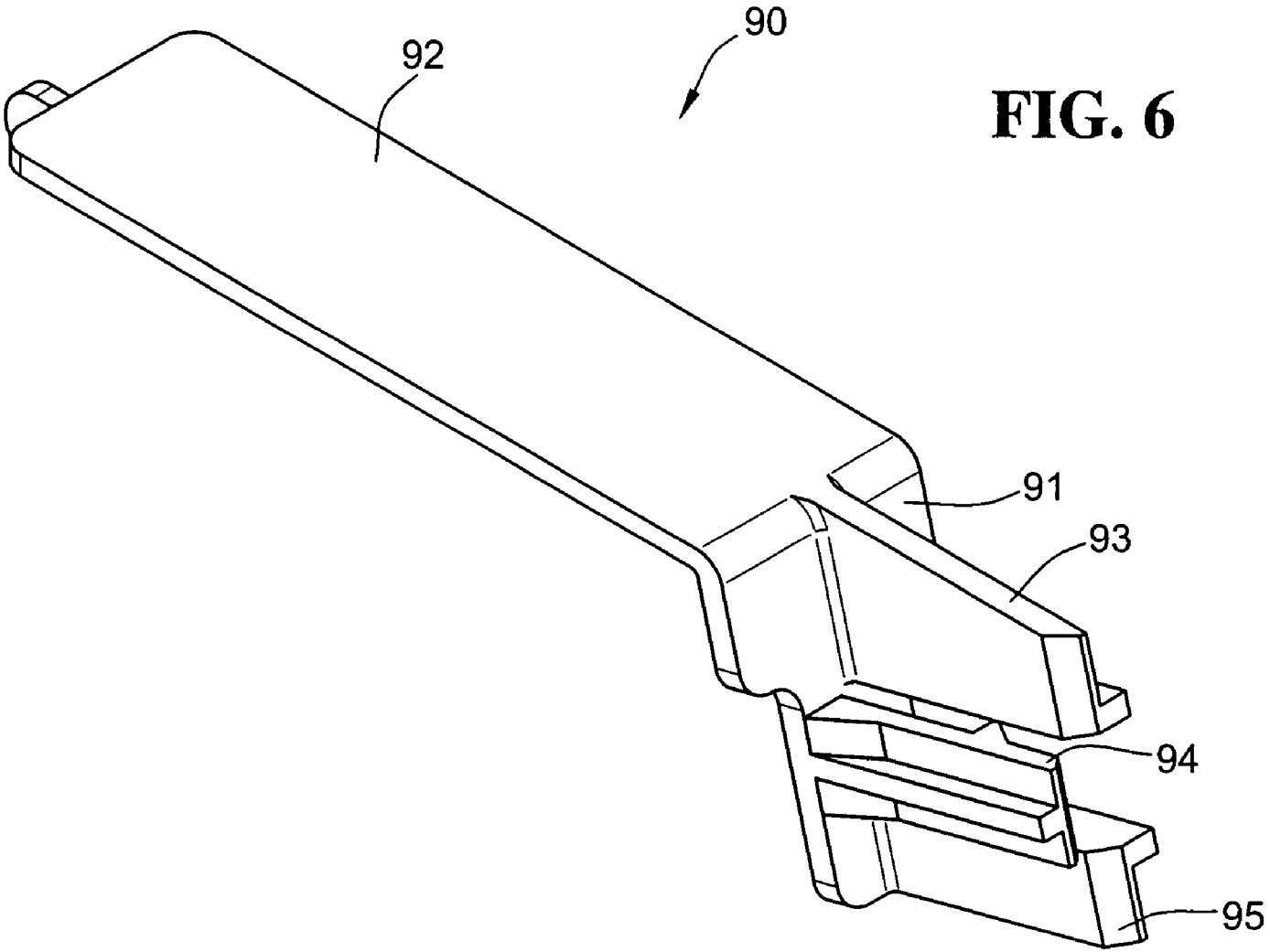
FIGS. 6 and 7 are isometric views of a second embodiment of a sign holder according to the principals of the present invention which are much like the first embodiment except that the sign holder is adapted to side-face rather than front-face a sign.
Figure 7:
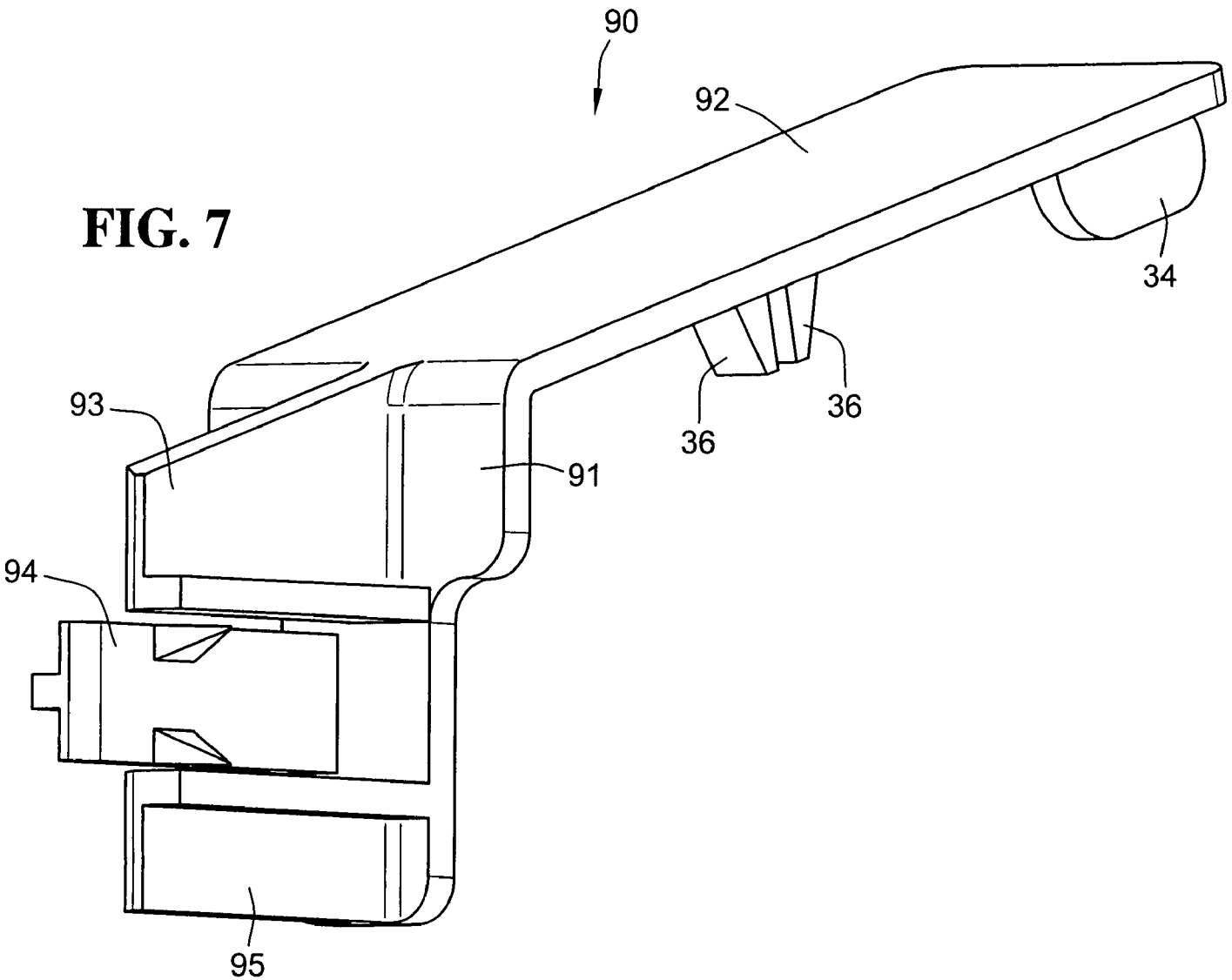
Figure 8:
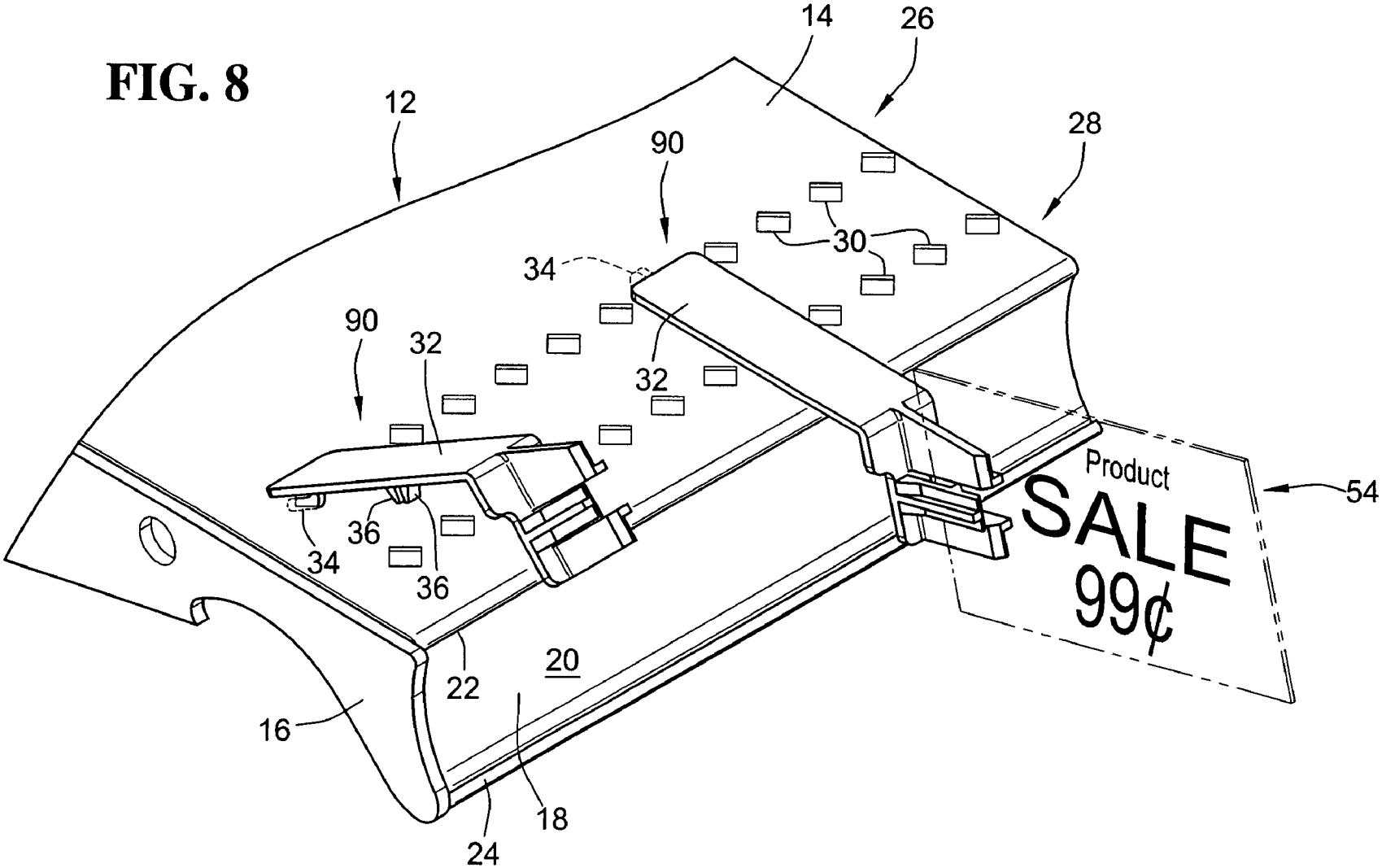
FIG. 8 is a view much similar to FIG. 5 but shown for the second embodiment of the sign holder shown in FIGS. 6 and 7 rather than the first embodiment.

Turning to the next embodiment of the present invention shown in FIGS. 6-8, a sign holder 90 is illustrated which is in many respects just like the first embodiment. Accordingly, description will be limited to those features which are substantially different from the first embodiment. In this embodiment, the means for gripping the sign has been rotated ninety degrees relative to the first embodiment. To facilitate this aspect, this embodiment further includes a forward flange 91 that extends vertically downward and slightly angled forwardly from the rearward extending mounting panel 92 of the clasp. The forward flange 91 thus defines the common base and provides a slot bottom against which a retail sign can bottom out. Each of the clasps 93, 94, 95 project forwardly from the sign holder 90 to facilitate securement of a sign much like the first embodiment but at a different orientation.

In this embodiment, the clasps 93, 94, 95 will support a sign in a substantially vertical orientation mounted sideways such that as retail customers walk down an aisle, they are able to see the sign from a distance rather than being directly on top of the sign and seeing it in a front facing situation as per the first embodiment.

Turning to FIGS. 9-15, additional embodiments of the present invention are illustrated which use a slightly different alternative mounting means for mounting the sign holder to a retail shelf. However again the clasp and the associated features work in a similar manner, and define the same types of structural features as per the first embodiment. In this embodiment, the mounting means is integrated more closely with the clasp.

Figure 9:
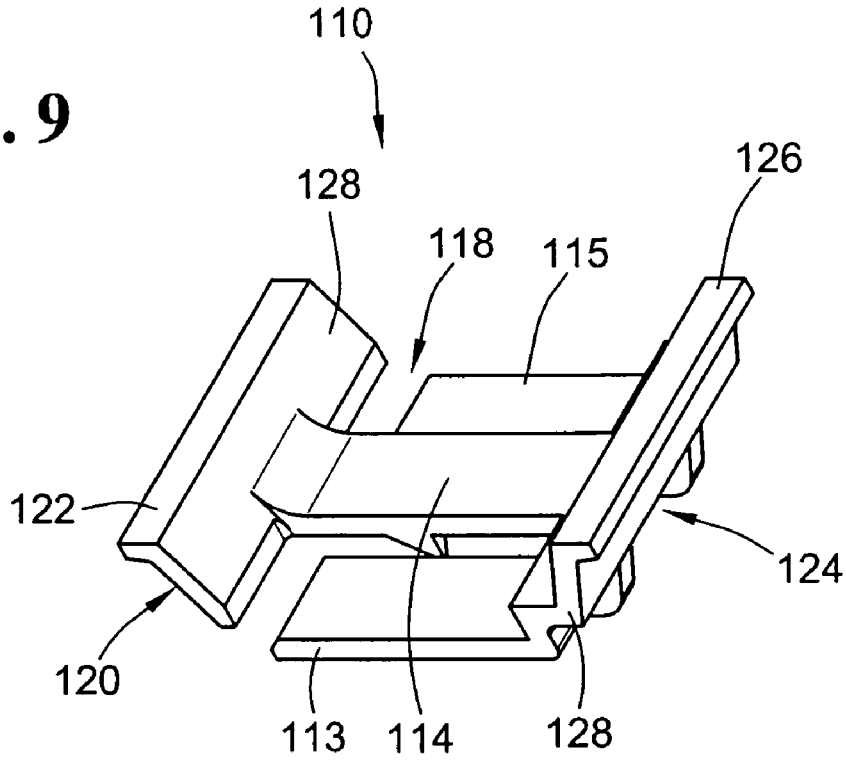
FIGS. 9 and 10 are isometric views of a third embodiment of a sign holder which is adapted for snapping connection to a C-channel type shelf.
Figure 10:
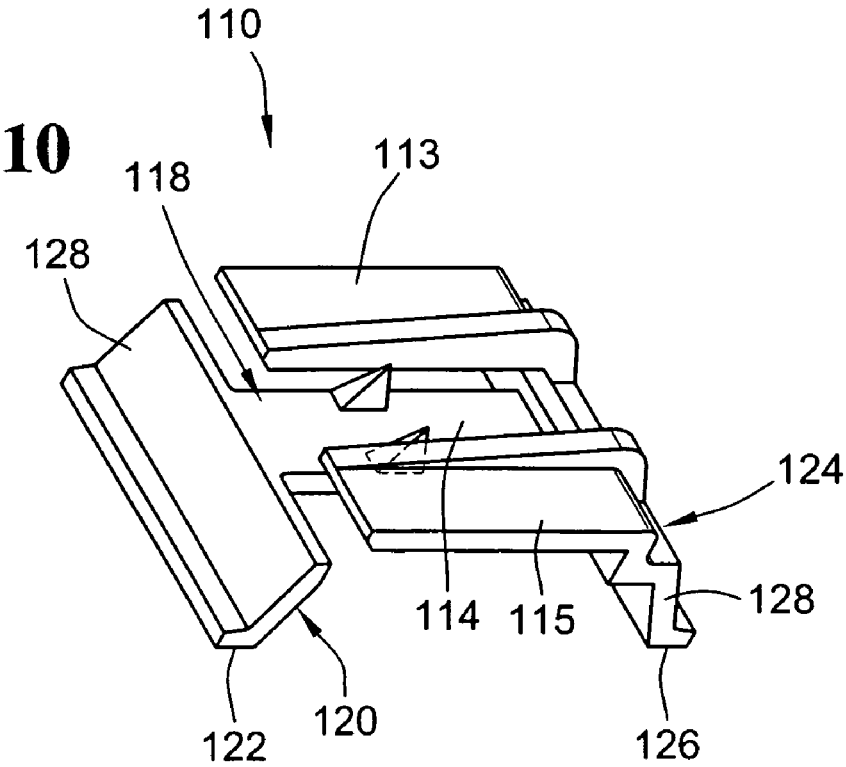
Figure 13:
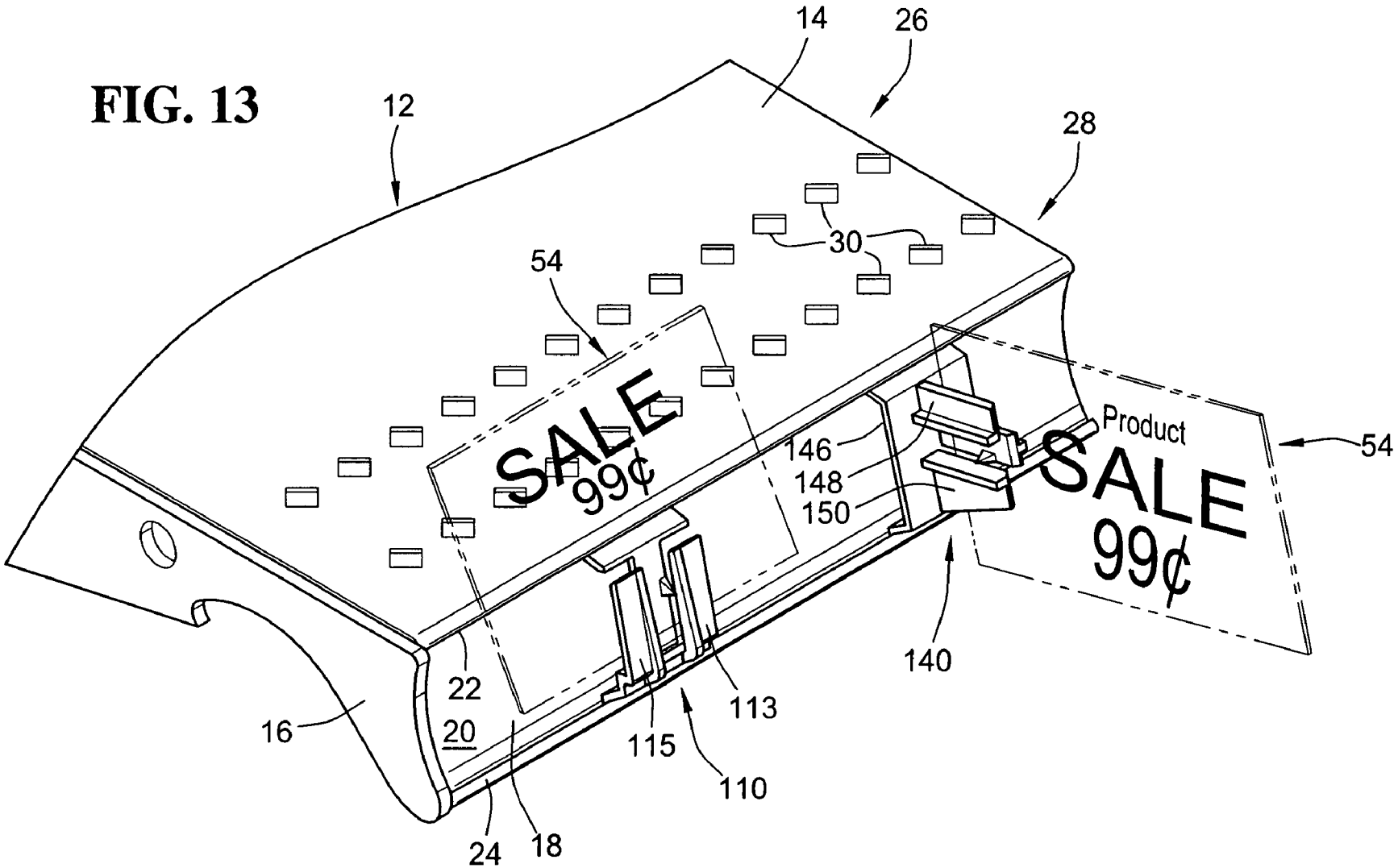
FIG. 13 is an isometric representation of the sign holders of the third and fourth embodiments shown in FIGS. 9-12, which are mounted to a C-channel of a retail shelf and holding signs in different orientations.

For example, as shown in FIG. 9, a sign holder 110 includes a plurality of clasps, 113, 114, 115 much like the first embodiment. However, in this embodiment, the sign holder 110 is configured for snap-in connection to the corresponding C-channel 18 of a retail shelf 12. Specifically, at one end at the common base 118 a first anchor 120 is provided with a rail 122 which is adapted to be snapped into the corresponding C-channel and engaged with the lower lip 24 of the corresponding C-channel 18. Additionally, a second anchor 124, which in this case is connected to the end portion of the intermediate clasp 114, includes a corresponding rail 126 which is adapted to be received and engaged with the corresponding upper lip 22 of the retail shelf 12. Each of the anchors 120, 124 include a generally rearward extending portion 128 so as to space and set off the clasps 113, 114, 115 away from the front end of the retail shelf so as to receive an appropriate retail sign. As shown in FIG. 13, the sign holder 110 of FIGS. 9-10 is adapted to front face an appropriate retail sign so that it can be read from directly in front of the shelf looking forwardly (rather than to the side).

Figure 11:
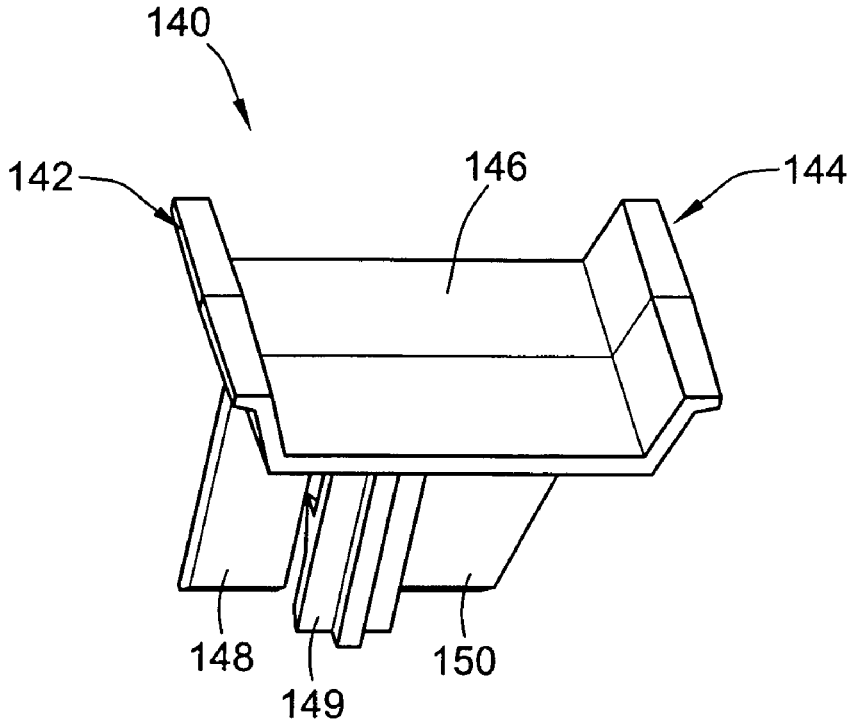
FIGS. 11 and 12 are isometric views of a fourth embodiment of a sign holder which is configured for snapping connection to a C-channel type shelf much like the third embodiment, but the difference being that it facilitates vertical sideways presentation of a sign rather than front-facing a sign.
Figure 12:
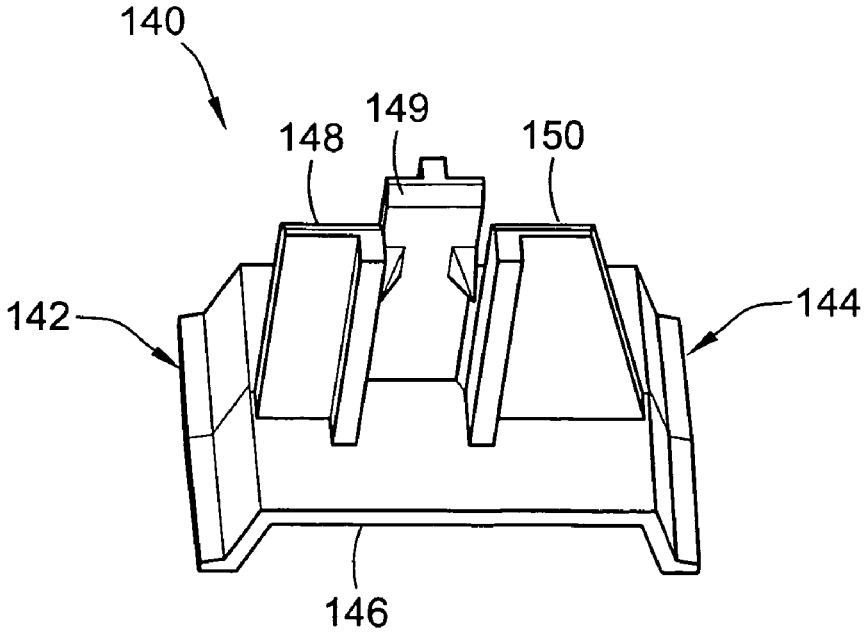

Turning to FIGS. 11-12, a further and fourth embodiment of the present invention is illustrated which is much like the third embodiment in terms of mounting means except that it is rotated sideways to face a retail sign much like the second embodiment. The sign holder 140 of the third embodiment also similarly includes top and bottom anchors 142, 144 configured for mounting into a C-channel of an appropriate shelf with appropriate rail and spacing mechanisms but also includes a corresponding generally vertical flange 146 extending therebetween so as to provide a means for supporting each of the clasps 148, 149, 150 and defining a common base from which the clasp 148-150 protrude to form the slot and associated features. The flange 146 also defines the slot bottom to provide a means for which a retail sign can bottom out and abut up against. The sign holder 140 of the fourth embodiment, much like the second embodiment, will display a retail sign sideways in a vertical orientation as illustrated in FIG. 13 so that a retail customer walking down an aisle of a retail store may be able to view the retail sign at a distance and not necessarily up upon the retail merchandise.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A retail display, comprising in combination:

(a) a retail shelf having a support panel for support of merchandise and a front face;

(b) a sign having retail information indicia pertaining to merchandise;

(c) a sign holder mounted to the retail shelf, the sign holder comprising:

(i) a body molded of resilient plastic material having a common base proximate the front face;

(ii) a plurality of clasps integrally joined to the base, each of the clasps projecting outward from the base and being resiliently flexible but otherwise non-movable relative to the base, including a first clasp and a second clasp in substantially fixed spaced relation to the first clasp, the first and second clasps holding opposing sides of the sign; and (iii) at least one gripping tab integrally projecting from at least one of the clasps, the gripping tab engaging the sign;

wherein the retail display further comprises a third clasp integral with the common base and extending outward from the base in spaced relation to the first clasp to form a gap therebetween, the second clasp being disposed intermediate the first and third clasps, the sign being disposed in a slot formed between the second clasp on a first side and the first and third clasps on a second side; and wherein each of the clasps comprises a slot wall extending along one of the sides of the slot, and a reinforcing rib projecting from the slot wall on a surface of the clasp opposite the side of the slot.

2. The retail display of claim 1, wherein the at least one gripping tab is formed on the second clasp and projects into the slot and toward the gap.

3. The retail display of claim 2, wherein the sign when installed in the slot resiliently flexes the first and third clasps away from the second clasp and the gripping tab pushes a middle portion of the sign into the gap, thereby trapping the middle portion between the first and third clasps.

4. The retail display of claim 3, wherein the gripping tab deforms the middle portion of the sign.

5. The retail display of claim 2, wherein the gripping tab comprises a pointed end engaging the sign but not extending through the sign.

6. The retail display of claim 3, wherein the second clasp comprises at least two of the gripping tabs, with a first gripping tab disposed along one edge and a second tab disposed along another edge.

7. The retail display of claim 1, wherein the gripping tab comprising forward means comprising a ramped forward surface for directing the sign into the slot when the sign is installed into the slot.

8. The retail display of claim 7, wherein the gripping tab comprises means comprising an approximately perpendicular rearward surface for preventing the sign from sliding out of the slot.

9. The retail display of claim 1, wherein the reinforcing ribs of the first and third clasps are disposed along opposed edges of the gap.

10. The retail display of claim 1, wherein the retail shelf includes a plurality of apertures through the support panel, the apertures being aligned in at least two rows including first and second rows of apertures being proximate said front face and extending generally parallel relative to the front face, and wherein the sign holder includes means for mounting the body to the retail shelf and for positioning the body along the front face, the mounting means comprising a snap prong snapped into an aperture in the first row, and a anchor arm projecting into an aperture in the second row, the anchor arm having an abutment adapted to engage a bottom side of the support panel to secure the sign holder to the retail shelf.

11. The retail display of claim 1, wherein the front face comprising a C-channel mounting face having a pair of parallel opposed rails, and wherein the sign holder includes means for mounting the body to the retail shelf and for positioning the body along the front face, the mounting means comprises a pair of anchor flanges in spaced apart relation, each anchor flange engaging one of the rails.

12. A sign holder for a retail display, the sign holder adapted to be mounted to a retail display, the sign holder comprising:

(i) a body molded of resilient plastic material having a common base;

(ii) means for mounting the body to the retail shelf and for positioning the common base along the front face;

(iii) a plurality of clasps integrally joined to the common base, each of the clasps projecting outward from the base and being resiliently flexible, including a first clasp and a second clasp in substantially fixed spaced relation to the first clasp, the first and second clasps defining a slot extending from the common base toward a sign entrance opening defined between opposed free ends of the first and second clasp; and (iv) at least one gripping tab projecting from at least one of the clasps, the gripping tab projecting into the slot; wherein the retail display further comprises a third clasp integral with the common base and extending outward from the common base in spaced relation to the first clasp to form a gap therebetween, the second clasp being disposed intermediate the first and third clasps, whereby a sign is adapted to be disposed in a slot formed between the second clasp on a first side and the first and third clasps on a second side; and wherein each of the clasps comprises a slot wall extending along one of the sides of the slot, and a reinforcing rib projecting from the slot wall on a surface of the clasp opposite the side of the slot.

13. The retail display of claim 12, wherein the at least one gripping tab is formed on the second clasp and projects toward the gap.

14. The retail display of claim 12, wherein the at least one gripping tab comprises a pointed end engaging the sign but not extending through the sign.

15. The retail display of claim 12, wherein the at least one gripping tab comprises at least two of the gripping tabs.

16. The retail display of claim 12, wherein the reinforcing ribs of the first and third clasps are disposed along opposed edges of the gap.

17. The retail display of claim 12, wherein the mounting means is connected to a panel extending rearward from the base, the mounting means including a snap prong and a generally L shaped anchor arm, the snap prong disposed intermediate the L-shaped anchor arm and the base.

18. The retail display of claim 12, wherein the mounting means comprises a pair of anchor flanges in spaced apart relation having parallel engagement edges for engagement with a C-channel.

* * * * *